US007171801B2

(12) United States Patent
Verkiel et al.

(10) Patent No.: US 7,171,801 B2
(45) Date of Patent: Feb. 6, 2007

(54) FILTER SYSTEM

(75) Inventors: Maarten Verkiel, Metamora, IL (US); Jo L. Williams, Peoria, IL (US); Eric Charles Fluga, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/874,319

(22) Filed: Jun. 24, 2004

(65) Prior Publication Data

US 2005/0284139 A1 Dec. 29, 2005

(51) Int. Cl.
*F01N 3/00* (2006.01)

(52) U.S. Cl. ..... 60/297; 60/286; 60/288; 60/295; 60/296; 60/301; 60/311

(58) Field of Classification Search ..... 60/274, 60/286, 295, 296, 311, 297, 287, 288; 422/169, 422/170, 175, 177
See application file for complete search history.

(56) References Cited

U.S. PATENT DOCUMENTS

| | | | | |
|---|---|---|---|---|
| 3,937,015 | A * | 2/1976 | Akado et al. | 60/288 |
| 4,887,427 | A * | 12/1989 | Shinzawa et al. | 60/286 |
| 5,293,742 | A * | 3/1994 | Gillingham et al. | 60/288 |
| 5,472,673 | A * | 12/1995 | Goto et al. | 422/169 |
| 5,792,436 | A * | 8/1998 | Feeley et al. | 423/210 |
| 6,233,927 | B1 * | 5/2001 | Hirota et al. | 60/297 |
| 6,293,096 | B1 * | 9/2001 | Khair et al. | 60/286 |
| 6,314,722 | B1 * | 11/2001 | Matros et al. | 60/274 |
| 6,348,177 | B1 * | 2/2002 | Bartley et al. | 422/177 |
| 6,408,620 | B2 * | 6/2002 | Boegner et al. | 60/295 |
| 6,594,991 | B2 * | 7/2003 | Itoh et al. | 60/286 |
| 6,679,052 | B2 * | 1/2004 | Nakatani et al. | 60/286 |
| 6,735,940 | B2 * | 5/2004 | Stroia et al. | 60/286 |
| 6,742,328 | B2 * | 6/2004 | Webb et al. | 60/285 |
| 6,820,414 | B2 * | 11/2004 | Stroia et al. | 60/286 |
| 6,820,417 | B2 * | 11/2004 | May et al. | 60/297 |
| 6,883,311 | B2 * | 4/2005 | Liu | 60/295 |
| 6,989,045 | B2 * | 1/2006 | Bailey et al. | 95/129 |
| 2003/0140622 | A1 * | 7/2003 | Taylor et al. | 60/295 |
| 2004/0098981 | A1 * | 5/2004 | Crawley et al. | 60/297 |

FOREIGN PATENT DOCUMENTS

| | | |
|---|---|---|
| EP | 1 174 598 A2 | 1/2002 |
| WO | WO 01/51178 A1 | 7/2001 |

* cited by examiner

*Primary Examiner*—Thomas Denion
*Assistant Examiner*—Diem Tran
(74) *Attorney, Agent, or Firm*—Finnegan, Henderson, Farabow, Garrett & Dunner

(57) ABSTRACT

A filter system includes a plurality of filter sections, each of the plurality of filter sections receiving a portion of flow. Each filter section includes a first filter, a second filter, an absorbing material disposed between the first and second filter, and at least one dispersion mechanism disposed between the first and second filter. The at least one dispersion mechanism assists in providing a fluid to the filter system.

48 Claims, 9 Drawing Sheets

FILTER SYSTEM

TECHNICAL FIELD

The present disclosure relates generally to a filter system, and more particularly to a filter system having regeneration capabilities.

BACKGROUND

Engines, including diesel engines, gasoline engines, natural gas engines, and other engines known in the art, may exhaust a complex mixture of air pollutants. The air pollutants may be composed of gaseous and solid material, including particulate matter, nitrogen oxides ("NOx"), and sulfur compounds.

Due to heightened environmental concerns, exhaust emission standards have become increasingly stringent over the years. The amount of pollutants emitted from an engine may be regulated depending on the type, size, and/or class of engine. One method that has been implemented by engine manufacturers to comply with the regulation of particulate matter and NOx exhausted to the environment has been to remove these pollutants from the exhaust flow of an engine with filters. However, using filters for extended periods of time may cause the pollutants to buildup in the components of the filters, thereby causing filter functionality and engine performance to decrease.

One method of improving filter performance may be to implement filter regeneration. For example, International Publication No. WO 01/51178 (the '178 publication) to Campbell et al., describes a method and apparatus for removing nitrogen oxides (NOx) and gaseous sulfur compounds such as $SO_2$ and $H_2S$ from engine exhaust using a catalyst filter system with regeneration capabilities. The catalyst filter system of the '178 publication is designed for use in lean burn internal combustion engines and comprises two identical catalyst sections arranged in parallel. Each catalyst section includes a sulfur selective catalyst and a NOx selective catalyst. Exhaust flow is directed through a first catalyst section to remove sulfur and NOx from the exhaust flow, while a second catalyst section undergoes a regeneration process. During the regeneration process, gas containing a reducing agent passes through the second catalyst section in a direction opposite the normal direction of flow. The gas flows through the NOx and sulfur selective catalysts and desorbs nitrogen and sulfur compounds collected thereon through regeneration. In this reverse flow direction, the gas contacts the NOx selective catalyst before the sulfur selective catalyst.

Although the catalyst filter system of the '178 publication may reduce the amount of NOx released to the environment, in order to avoid collecting sulfur on the NOx absorber of the second catalyst section during regeneration, the filter system requires a separate catalyst section for filtering the exhaust flow. Incorporating a second catalyst section may substantially increase the overall cost of the filter system and may double the space requirements of the system.

The present disclosed filter system is directed to overcoming one or more of the problems set forth above.

SUMMARY OF THE INVENTION

In one embodiment of the present disclosure, a filter system includes a plurality of filter sections, each of the plurality of filter sections receiving a portion of flow. Each filter section includes a first filter, a second filter, an absorbing material disposed between the first and second filter, and at least one dispersion mechanism disposed between the first and second filter, the at least one dispersion mechanism assisting in providing a fluid to the filter system.

In another embodiment of the present disclosure, a filter system of an internal combustion engine includes a first sulfur trap, a second sulfur trap, and a NOx absorber disposed between the first and second sulfur trap.

In still another embodiment of the present disclosure, a method of regenerating a filter system of an internal combustion engine includes collecting constituents of engine exhaust by providing flow through a filtering component, sensing a filtered flow of engine exhaust downstream of the filtering component, and injecting a reductant into the engine exhaust upstream of the filtering component to assist in removing the collected constituents from the filter system.

In yet another embodiment of the present disclosure, a method for removing constituents from a flow of engine exhaust of an internal combustion engine includes removing constituents of the engine exhaust with a first sulfur trap upstream of a NOx absorber during a normal flow path through the filter system and removing constituents of the engine exhaust with a second sulfur trap upstream of the NOx absorber during a reversed flow path through the filter system.

In a further embodiment of the present disclosure, a filter system includes a plurality of filter sections, each of the plurality of filter sections receiving a portion of flow, and each filter section including a first filter having a first filter portion and a second filter portion, a second filter, and at least one dispersion mechanism disposed between the first and second filter, the at least one dispersion mechanism assisting in providing a fluid to the filter system.

DETAILED DESCRIPTION

Exemplary embodiments of the present disclosure are illustrated in the accompanying drawings. Wherever possible, the same reference numbers will be used throughout the drawings to refer to the same or like parts.

Figure 1:
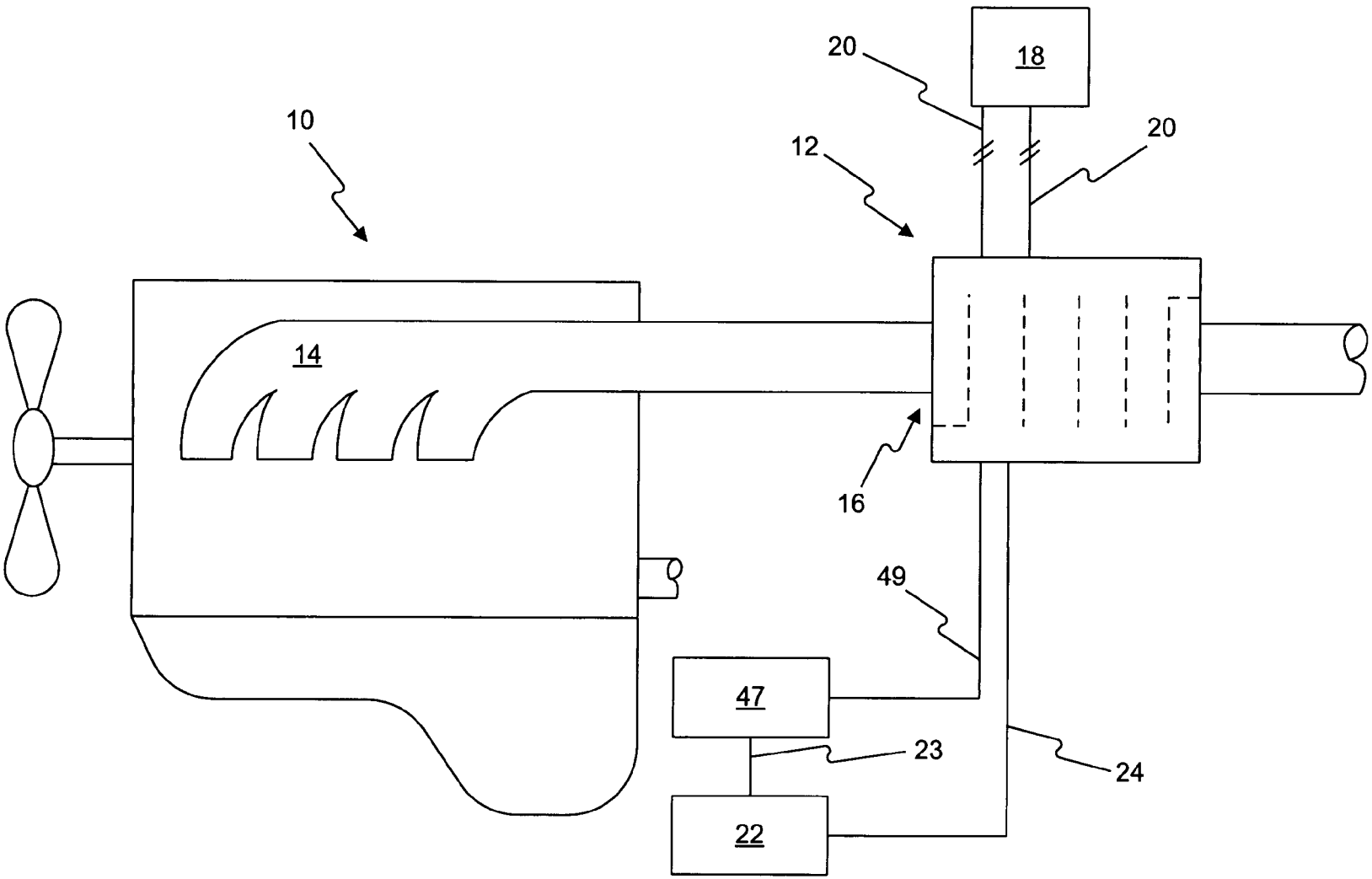
FIG. 1 is a diagrammatic illustration of an engine having a filter system according to an exemplary embodiment of the present disclosure.

FIG. 1 illustrates an internal combustion engine 10, such as a diesel engine, having an exemplary embodiment of a filter system 12. Engine 10 may include an exhaust manifold 14 connecting an exhaust flow of engine 10 with an inlet 16 of filter system 12. A controller 18 may be in communication with one or more components of filter system 12 via one or more communication lines 20. A reformer 47 may also be in communication with one or more components of the filter system 12 via a reformer line 49. A reductant supply 22 may be fluidly connected to the reformer 47 through a reductant line 23, and/or directly to one or more components of the filter system 12, via a direct reductant line 24. Engine 10 may also include a turbo (not shown) connected to the exhaust manifold 14. In such an embodiment, inlet 16 of the filter system 12 may be connected to an outlet of the turbo.

Figure 2:
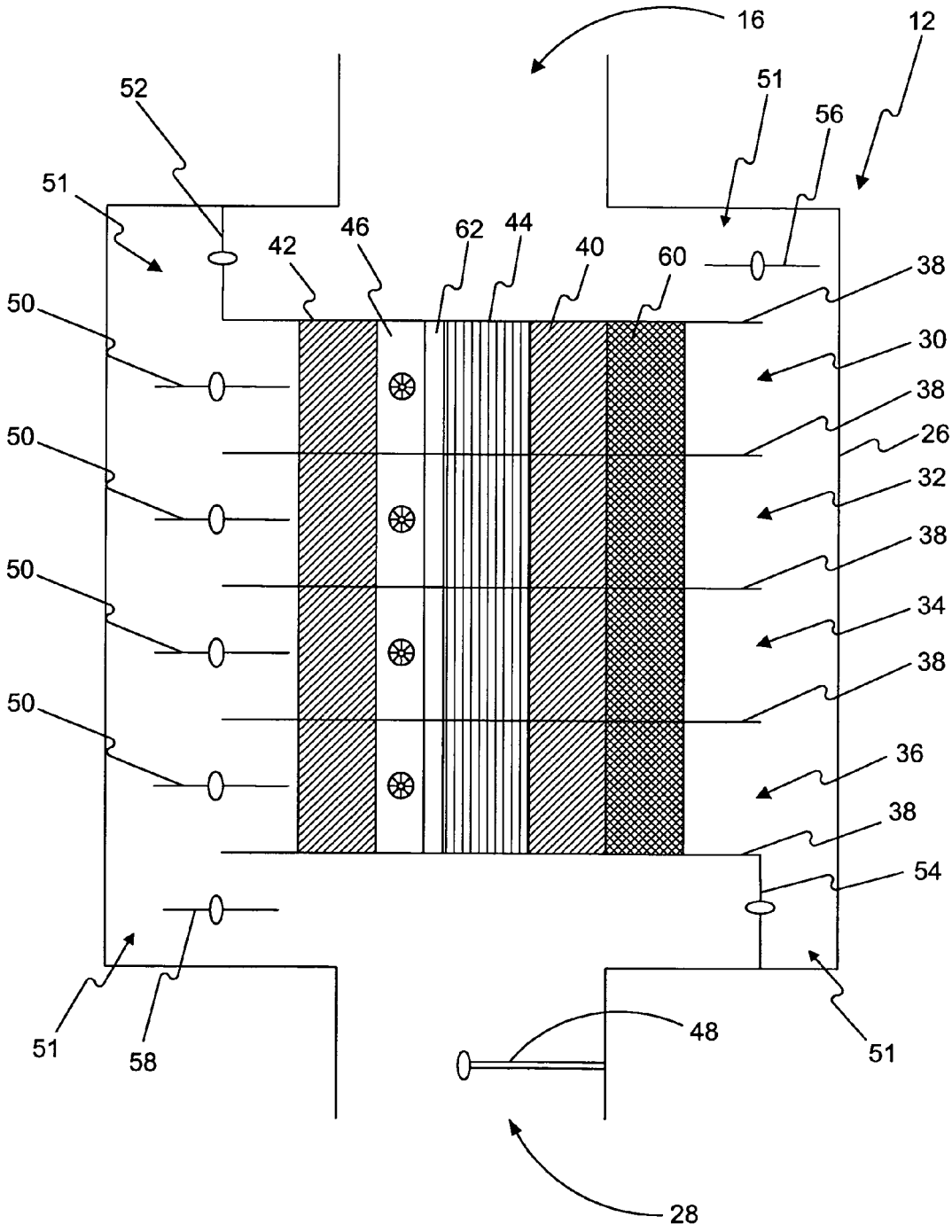
FIG. 2 is a front view diagrammatic illustration of a filter system according to an exemplary embodiment of the present disclosure.

As illustrated in FIG. 2 the filter system 12 may include a number of legs through which an exhaust flow from the engine 10 may flow. In an embodiment of the present disclosure, the filter system 12 may include a first leg 30, a second leg 32, a third leg 34, and a fourth leg 36. Each leg 30, 32, 34, 36 may be separated by one or more insulating dividers 38. Although FIG. 2 shows only four legs 30, 32, 34, 36, the filter system 12 of the present disclosure may include any number of legs useful in removing particulates, ash, or other materials from an exhaust flow. The legs 30, 32, 34, 36 may be arranged horizontally (as shown in FIG. 2), vertically, radially, helically, or in any other configuration useful in removing materials from exhaust flow.

Each of the legs 30, 32, 34, 36 may include a NOx absorber 44 disposed between a first and second sulfur trap 40, 42 as shown in FIG. 2. The NOx absorber 44 may be any type of NOx absorber known in the art. The NOx absorber 44 may contain catalyst materials capable of storing oxides of nitrogen. Such materials may include, for example, aluminum, platinum, rhodium, barium, cerium, and/or alkali metals, alkaline-earth metals, rare-earth metals, or combinations thereof. The catalyst materials may be situated within the NOx absorber 44 so as to maximize the surface area available for NOx absorption. These catalyst materials may be located on a substrate of the NOx absorber 44. Substrate configurations may include, for example, a honeycomb, mesh, or any other configuration known in the art. The NOx absorber 44 may connect to a housing 26 of the filter system 12 by any conventional means.

The first and second sulfur traps 40, 42 may be any type of sulfur traps known in the art, and may contain materials such as, but not limited to, zinc, nickel, copper, magnesium, manganese, potassium, alumina, ceria, silica, or other materials capable of adsorbing and/or absorbing sulfur or sulfur compounds from an exhaust flow. These materials may result in sulfur purging characteristics superior to that of the NOx absorber 44. For example, if sulfur should happen to reach the NOx absorber 44 and be collected therein, the sulfur may only be purged from the NOx absorber 44 catalyst materials at very high temperatures. Purging at such high temperatures may rapidly degrade the catalyst materials and shorten the life of the filter system 12. The materials used in the sulfur traps 40, 42, however, may be purged of sulfur at much lower temperatures. Purging at these lower temperatures may extend the useable life of the catalysts and the filter system 12.

Similar to the NOx absorber 44, catalyst materials may be situated within the sulfur traps 40, 42 so as to maximize the surface area available for sulfur absorption. Such configurations may include, for example, a honeycomb, mesh, or any other configuration known in the art. The sulfur traps 40, 42 may connect to the housing 26 of the filter system 12 by any conventional means.

As illustrated in FIG. 2, the first sulfur trap 40 may be positioned upstream of the NOx absorber 44 during normal flow conditions so as to shield the NOx absorber 44 from receiving sulfur or sulfur compounds contained within an exhaust flow during such normal flow conditions. The second sulfur trap 42 may be positioned downstream of the NOx absorber 44 so as to shield the NOx absorber 44 from receiving sulfur or sulfur compounds contained within an exhaust flow during regeneration and/or reversed exhaust flow conditions. The first and second sulfur traps 40, 42 may be the same type of trap, or may be different types of traps depending on the application the filter system 12 is being used for. For example, in some embodiments of the present disclosure, the flow through the filter system 12 may only be reversed for a short period of time for regeneration. In such embodiments, it may be advantageous to use a smaller, or less expensive second sulfur trap 42 downstream of the NOx absorber 44 to reduce the overall size and cost of the filter system 12.

As shown in FIG. 2, each leg 30, 32, 34, 36 may further include one or more nozzles 46, a regeneration valve 50, a particulate matter filter 60, and a heat supply 62. The nozzles 46 may be positioned between the first and second sulfur traps 40, 42 as illustrated in FIG. 2. The term "nozzle" 46 as used herein, is defined as any dispersion mechanism or other mechanism capable of dispensing a flow of gas or fluid supplied to it. The nozzles 46 may be, for example, fuel injectors, port flow injectors, or any type of nozzles capable of distributing reductant across a cross-section of the legs 30, 32, 34, 36 in a controlled manner. The nozzles 46 may be, for example, connected to the housing 26 of the filter system 12, or may be connected directly to either the NOx absorber 44, or one of the sulfur traps 40, 42. The connection may be made by any conventional connection apparatus known in the art.

The reductant may be raw diesel fuel, reformed diesel fuel, carbon monoxide, hydrogen, a hydrocarbon gas, reformate, or any combination thereof. It is understood that the reductant may also be any other reduction agent known in the art and that the type of nozzle 46 employed may depend on the type of reductant used. It is also understood that the reductant may be a fluid. As used herein, the term "fluid" may be defined as a substance in either a liquid or gaseous state.

Some types of reductants may also consist of a carrier gas known in the art. This carrier gas may be required if a non-gaseous reductant such as, for example, liquid diesel fuel is used as a reductant. In such an embodiment, the carrier gas may mix with the diesel fuel and carry the diesel through the catalyst.

The nozzles 46 may be supplied with reductants from a number of different sources. For example, as schematically illustrated in FIG. 1, the filter system 12 may be fluidly connected to a reformer 47 through a reformer line 49. As will be discussed in greater detail later, the reformer 47 may be capable of partially oxidizing the reductant supplied to the nozzles 46. The reformer 47 may be any type of reformer known in the art including, for example, a plasma fuel reformer and may supply reductant to the nozzles 46. The different types of plasma fuel reformers capable of being used with the filter system 12 of the present disclosure include those produced by Arvin Meritor of Troy, Mich., or Hydrogen Source LLC of South Windsor, Conn. Alternatively, if diesel fuel is used as the reductant in the regeneration process, the reformer 47 may be omitted. In such an embodiment, the nozzles 46 may be supplied with reductants directly from the reductant supply 22 through the direct reductant line 24.

Referring again to FIG. 2, the regeneration valves 50 located in each leg 30, 32, 34, 36 may be, for example, poppet valves, butterfly valves, or any other type of controllable flow valves known in the art. Each regeneration valve 50 may be capable of controlling the flow through its respective leg 30, 32, 34, 36. Each regeneration valve 50 may be controllably positioned to allow any range of flow through the leg 30, 32, 34, 36, from completely restricting flow to completely unrestricting flow. The valves 50 may be connected directly to the housing 26 of the filter system 12, or to the leg 30, 32, 34, 36 of the filter system 12, by any conventional connection apparatus known in the art. Each regeneration valve 50 may be actuated or otherwise controlled by, for example, a solenoid (not shown) or other actuation device known in the art.

The actuation device may receive a control signal from the controller 18 (FIG. 1). The controller 18 may be, for example, an electronic control module ("ECM"), a central processing unit, a personal computer, a laptop computer, or any other control device known in the art. The controller 18 may receive input from a variety of sources including, for example, filter system sensors 48 (described in greater detail below) and engine sensors (not shown). Engine sensors may include, but are not limited to, speed, load, temperature, and position sensors. The controller 18 may use these inputs to form a control signal based on a pre-set algorithm. The control signal may be transmitted from the controller 18 to each regeneration valve 50, or each actuation device, across the communication lines 20 (FIG. 1). Thus, the flow through each leg 30, 32, 34, 36 of the filter system 12 may be independently controlled.

Referring again to FIG. 2, in one embodiment of the present disclosure, a particulate matter filter 60 may be located upstream of the NOx absorber 44 during normal flow, and may be positioned to extract particulate matter from the exhaust flow before the flow reaches the NOx absorber 44. The particulate matter filter 60 may include, for example, a ceramic substrate, a metallic mesh, foam, or any other porous material known in the art. These materials may form, for example, a honeycomb structure within the particulate matter filter 60 to facilitate the removal of particulates. The particulates may be, for example, soot.

It is understood that in some embodiments, the filter system 12 may not include a particulate matter filter 60. In other embodiments, such as the embodiment shown in FIG. 2*a*, the particulate matter filter 60 may be positioned, for example, downstream of the NOx absorber 44, or in any other location within each of the legs 30, 32, 34, 36 relative thereto.

In other embodiments of the present disclosure, the particulate matter filter 60 may include catalyst materials useful in collecting, absorbing, adsorbing, and/or storing oxides of sulfur and/or nitrogen contained in a flow. Such catalyst materials may be the same as or similar to the catalyst materials discussed above. These catalyst materials may be added to the particulate matter filter 60 by any conventional means such as, for example, coating or spraying, and the particulate matter filter 60 may be partially or completely coated with the materials. For example, as shown in FIG. 2*b*, a particulate matter filter 60*a* may include a sulfur trap portion 40*a* and a NOx absorber portion 44*a*. The sulfur trap portion 40*a* may be capable of absorbing and/or storing sulfur or sulfur compounds contained in an exhaust flow before the flow reaches the NOx absorber portion 44*a* during a normal flow condition. Such a flow condition will be discussed in greater detail below. In this embodiment, the first sulfur trap 40 and the NOx absorber 44 of the embodiment of FIG. 2 may be omitted.

In still other embodiments, the particulate matter filter 60 may include catalyst materials useful in collecting, absorbing, adsorbing, and/or storing oxides of sulfur contained in a flow, and may include the same or similar catalyst materials as those discussed above. For example, as shown in FIG. 2*c*, the particulate matter filter 60*b* may include a sulfur trap portion 42*b* capable of absorbing sulfur or sulfur compounds from an exhaust flow. The sulfur trap portion 42*b* may be capable of absorbing and/or storing sulfur or sulfur compounds contained in an exhaust flow before the flow reaches the NOx absorber 44 in a reversed flow condition. Such a flow condition will be discussed in greater detail below. In this embodiment, the second sulfur trap 42 of the embodiment of FIG. 2 may be omitted.

As shown in FIG. 2, the filter system 12 may further include at least one heat supply 62 capable of assisting in the regeneration of particulate. A heat supply 62 may be attached to each of the legs 30, 32, 34, 36 to assist in regenerating the components of that respective leg. The heat supply 62 may be, for example, an electric heater, a fuel-fired burner, a spark plug, or any other heat supply known in the art. Alternatively, the filter system 12 may not include a heat supply 62, but instead may rely on the exothermic regeneration reactions taking place between the reductant and the oxidants present in each leg to supply heat.

The filter system 12 may also include one or more valving mechanisms 51 positioned to control the direction of flow within the filter system 12. The valving mechanisms 51 may be, for example, rotary valving mechanisms or any other type of valving mechanisms capable of directing flow known in the art. The valving mechanisms 51 may be positioned to reverse flow through the filter system 12, and may include a number of flow valves to facilitate the reversal of flow. For example, in one embodiment of the present disclosure, the valving mechanisms 51 may include a first, second, third, and fourth flow valve 52, 54, 56, 58. It is understood that the valving mechanisms 51 may include any number of valves useful in reversing flow through the filter system 12. It is also understood that the valving mechanisms 51 may include one or more motors (not shown), solenoids, or other devices known in the art to separately or collectively actuate elements of the valving mechanisms 51. The devices used to actuate each valve 52, 54, 56, 58 may depend on the type of valve used and the application in which the filter system 12 of the present disclosure is employed. These devices may receive, and be responsive to, commands from the controller 18 sent across the communication lines 20.

As discussed above with respect to the regeneration valves 50, the flow valves 52, 54, 56, 58 of the valving mechanisms 51 may be, for example, butterfly valves, poppet valves, or any other type of controllable valves known in the art, and may be connected to the housing 26 of the filter system 12 by any conventional connection apparatus, at locations facilitating the reversal of flow.

The filter system 12 may further include at least one sensor 48. This sensor 48 may be, for example, a NOx sensor, an oxygen sensor, a temperature sensor, or other sensor capable of sensing properties of a gaseous flow. The at least one sensor 48 may have multiple capabilities. For example, in addition to detecting the presence and quantity of NOx in a flow, a NOx sensor 48 may also be capable of measuring the air to fuel ratio of that flow. In an alternative embodiment, an oxygen sensor 48 may be used determine the air to fuel ratio, and may be used in conjunction with, or instead of, a NOx sensor.

The sensor 48 may be located anywhere within, or relative to, the filter system 12 depending on the sensor's size, shape, type, and function. For example, as FIG. 2 illustrates, a sensor 48 may be located at an outlet 28 of the filter system 12 or further downstream of the system 12. Alternatively, more than one sensor 48 may be used, in which case the sensors 48 may be positioned downstream of NOx absorber 44 in each leg 30, 32, 34, 36 of the filter system 12, or within the structure of the NOx absorber 44. The at least one sensor 48 may be connected to the housing 26 or to the legs 30, 32, 34, 36 of the filter system 12 by any conventional means.

INDUSTRIAL APPLICABILITY

The disclosed filter system 12 may be used with any device known in the art where the removal of pollutants from an exhaust flow is desired. Such devices may include, for example, a diesel, gasoline turbine, lean-burn, or other combustion engines or furnaces known in the art. Thus, the disclosed filter system 12 may be used in conjunction with any work machine, on-road vehicle, or off-road vehicle known in the art. The operation of filter system 12 will now be explained in detail.

Figure 3:
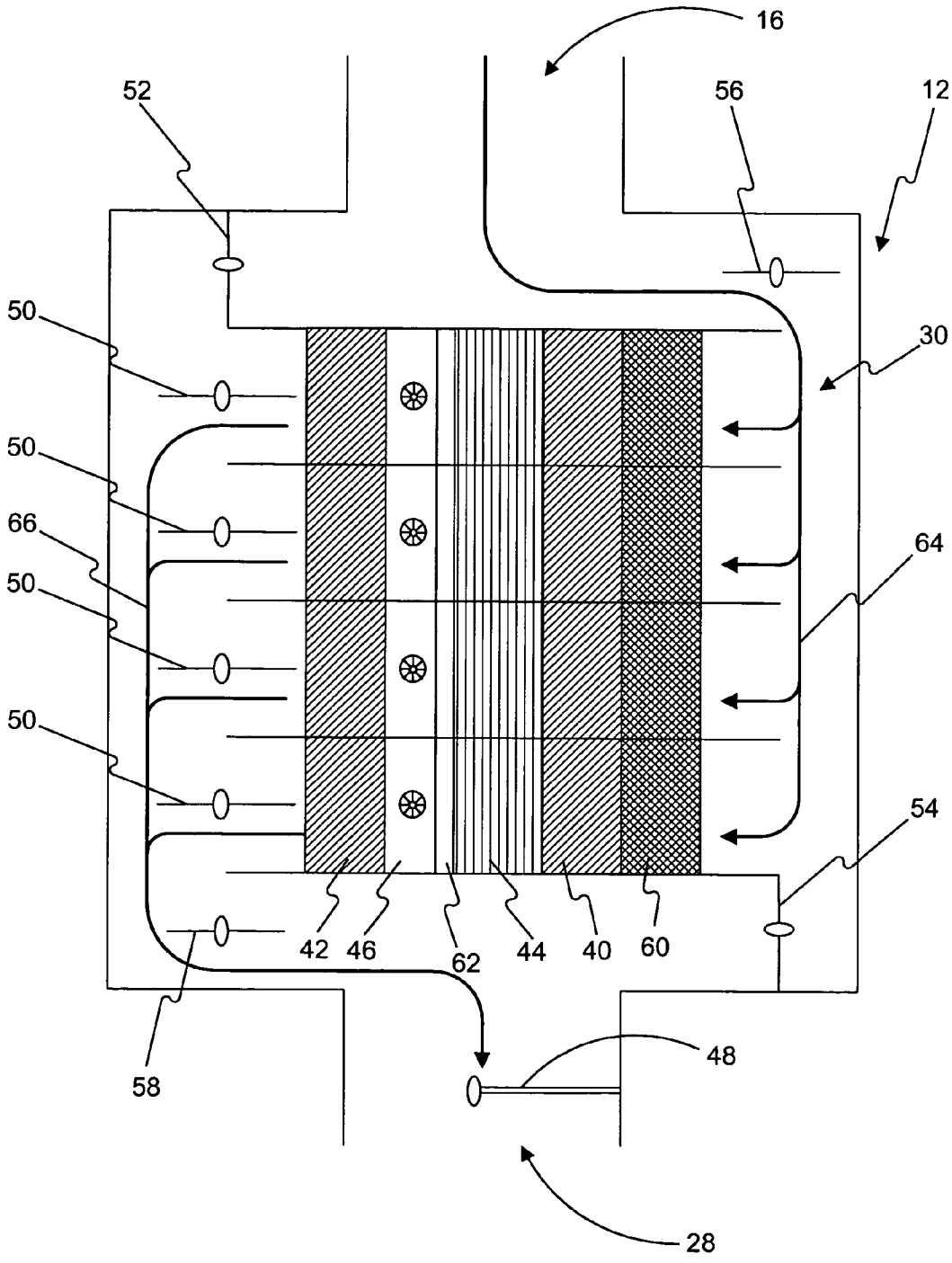
FIG. 3 is a front view diagrammatic illustration of the filter system of FIG. 2 in a normal flow condition.

FIG. 3 illustrates a normal flow condition for a filter system 12 according to an embodiment of the present disclosure. Under normal flow conditions, exhaust from an engine 10 (FIG. 1) may enter the inlet 16 of the filter system 12 and be directed to flow in a direction corresponding to normal flow arrows 64. As shown in FIG. 3, the first and second flow valves 52, 54 may be in a closed position and the third and fourth flow valves 56, 58 may be in an open position to facilitate the normal flow of exhaust. A portion of the exhaust may flow to each leg 30, 32, 34, 36 of the filter system 12 and the portion may pass through each component of the respective leg 30, 32, 34, 36 before exiting the leg. For example, a portion of the exhaust flowing through the first leg 30 may flow through the particulate matter filter 60, thereby removing at least some of the particulate matter contained in the exhaust. The particulate matter filter 60 may be capable of removing soot and other particulate matter from an exhaust flow by, for example, mechanical collection, wet scrubbing, electrostatic precipitation, filtration, or any other method known in the art.

The portion of the exhaust may then flow through the first sulfur trap 40, thereby removing at least some of the sulfur carried by the exhaust gases. During normal flow conditions, substantially all of the sulfur may be removed by the first sulfur trap 40 before the exhaust gas reaches the NOx absorber 44.

The portion of the exhaust may then flow through the NOx absorber 44. The NOx absorber 44 may remove at least some of the NOx from the exhaust flow passing through it. The portion of the exhaust may then pass the heat supply 62 (e.g. electric heater) and the nozzle 46 before it passes through the second sulfur trap 42. In passing these elements 62, 46, the exhaust gas may pass proximate to them, over them, or through them. It is understood that regardless of how these elements 62, 46 are positioned within the leg 30, the elements 62, 46 may not restrict exhaust flow from the NOx absorber 44 to the second sulfur trap 42 or vise versa.

Figure 2A:
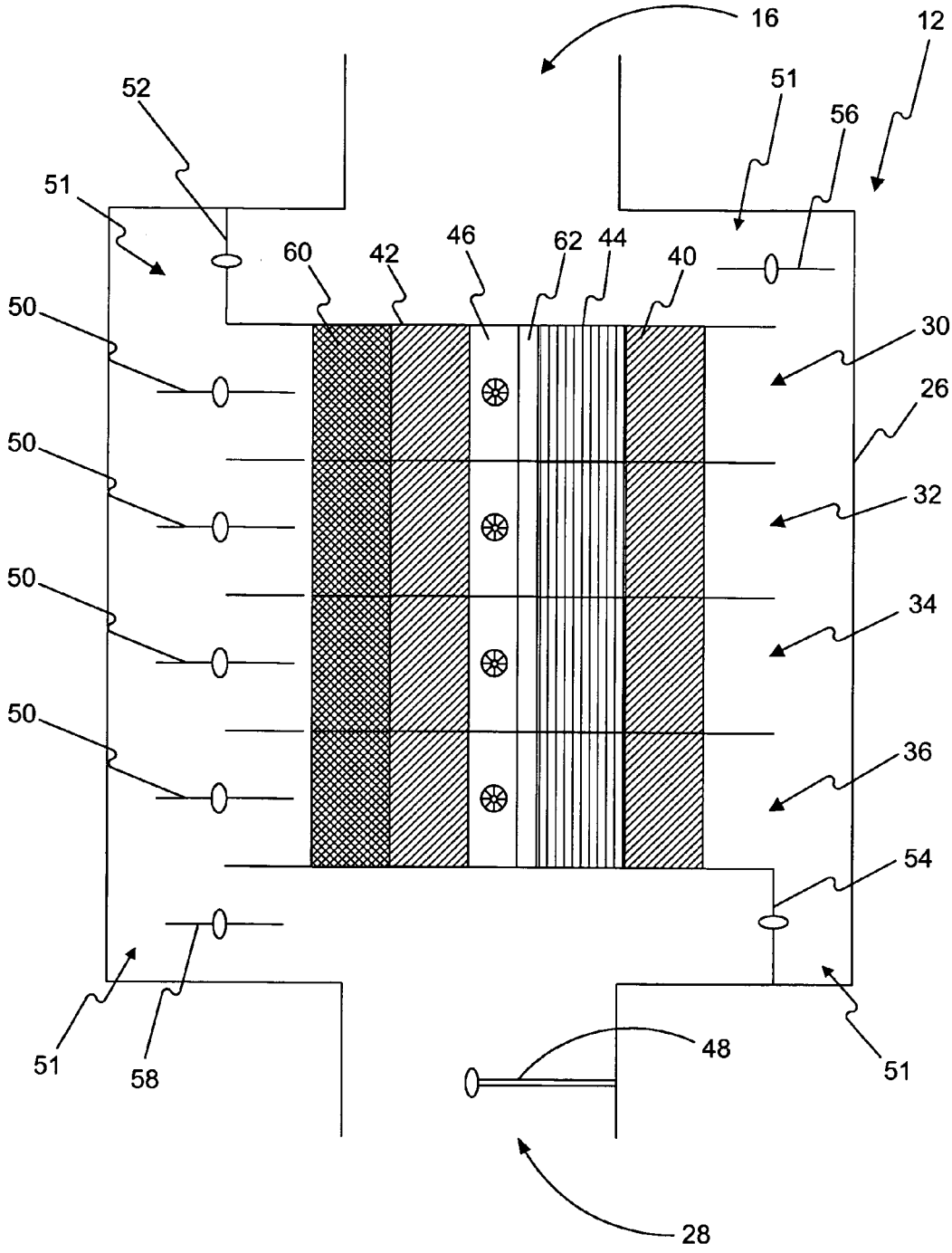
FIG. 2*a* is a front view diagrammatic illustration of a filter system according to another exemplary embodiment of the present disclosure.
Figure 2B:
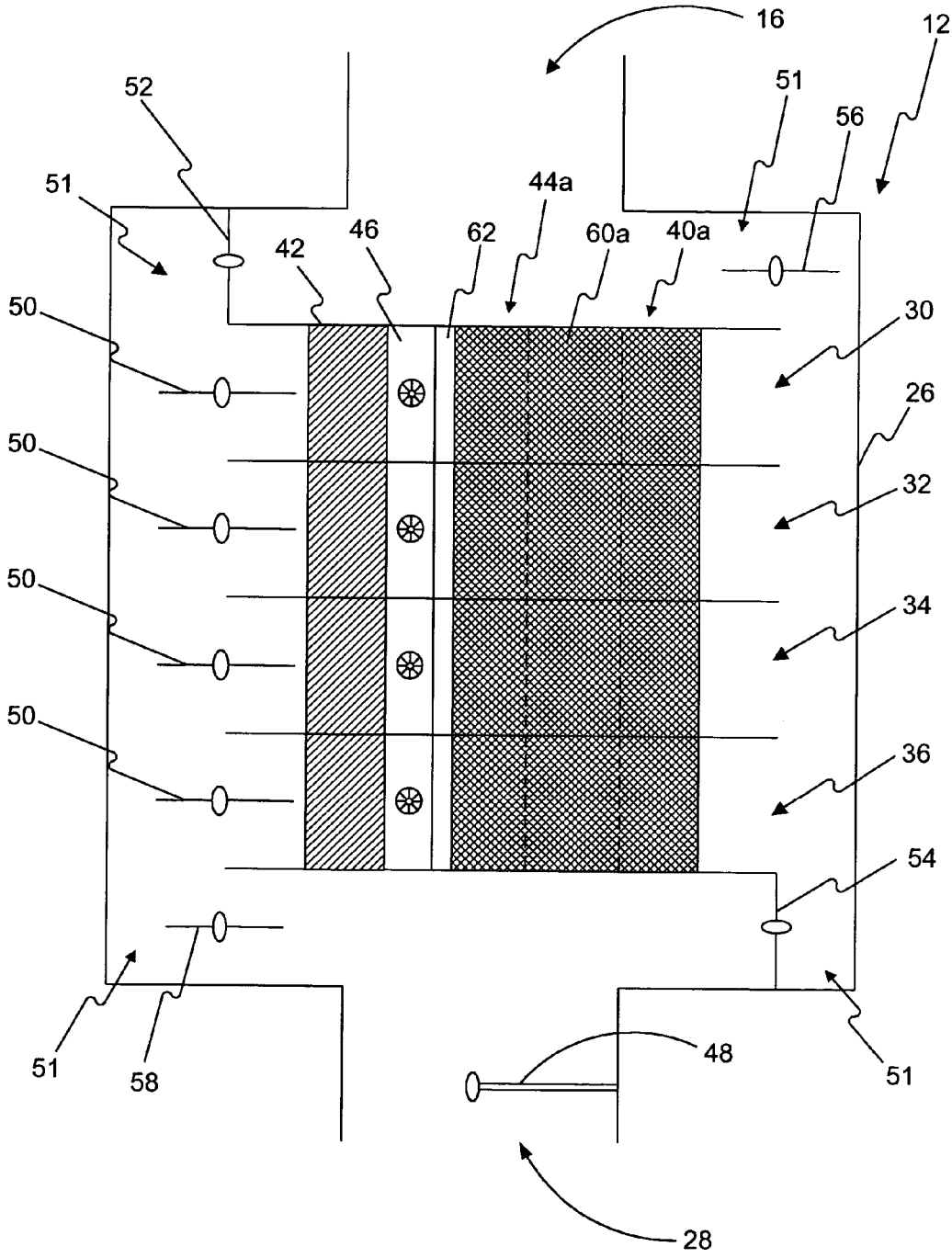
FIG. 2*b* is a front view diagrammatic illustration of a filter system according to yet another exemplary embodiment of the present disclosure.
Figure 2C:
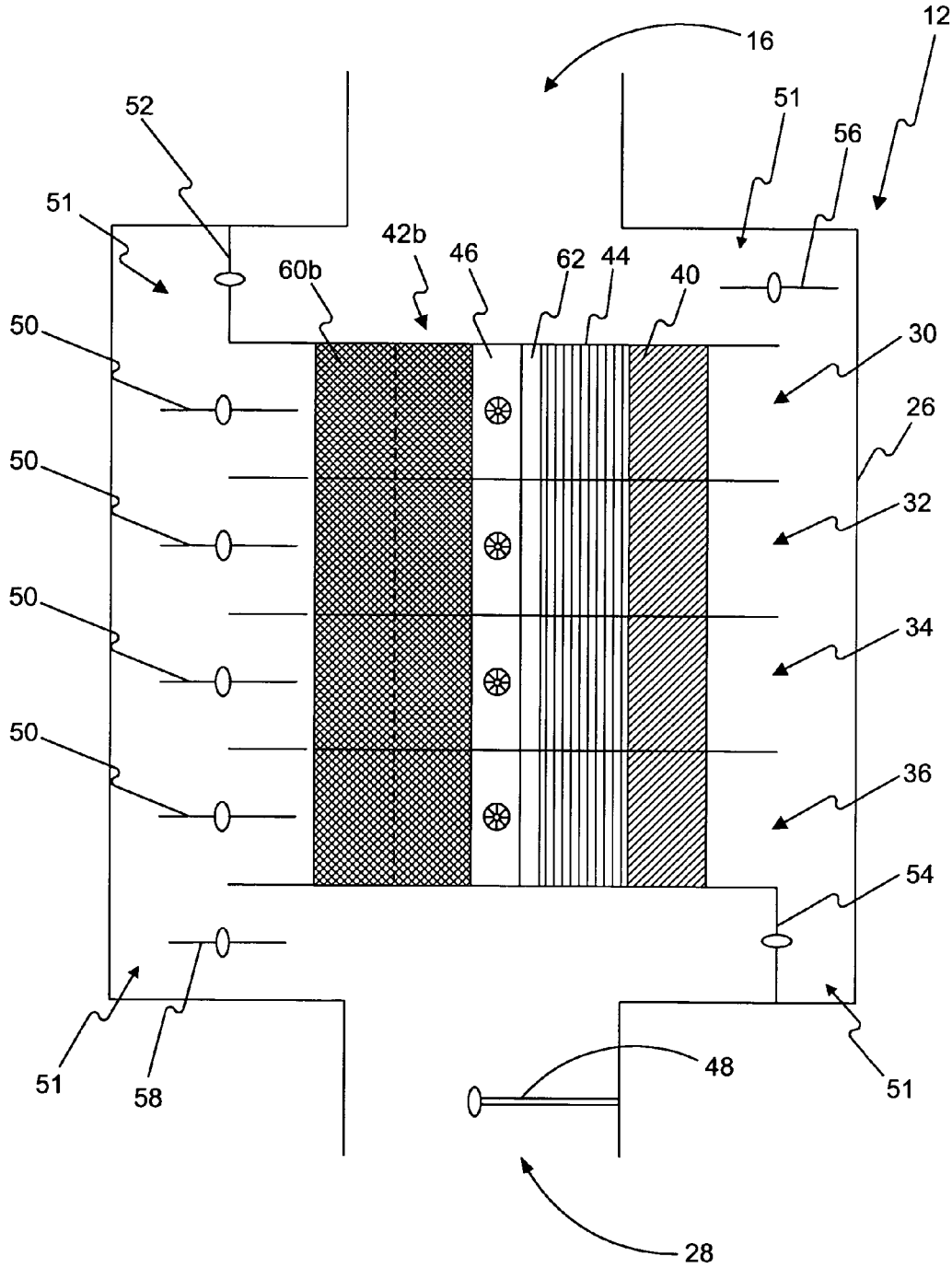
FIG. 2*c* is a front view diagrammatic illustration of a filter system according to still another exemplary embodiment of the present disclosure.

It is understood that in embodiments such as the embodiment of FIG. 2*a*, a portion of the exhaust may flow through the first sulfur trap 40, the NOx absorber 44, and the second sulfur trap 42 before passing through the particulate matter filter 60 in a normal flow condition. In the embodiment of FIG. 2*b*, on the other hand, the portion may first flow through the sulfur trap portion 40*a* and the NOx absorber portion 44*a* of the particulate matter filter 60*a* before passing through the second sulfur trap 42 in a normal flow condition. In the embodiment shown in FIG. 2*c*, the may flow through first sulfur trap 40 and NOx absorber 44 before flowing through the sulfur trap portion 42*b* of the particulate matter filter 60*b* in a normal flow condition. In each of these embodiments, the portion of the exhaust may also pass the heat supply 62 and/or the nozzle 46 in a normal flow condition as explained above.

Upon exiting the respective legs 30, 32, 34, 36, the portions of the exhaust flow may travel in a direction corresponding to normal flow arrows 66. As shown in FIG. 3, fourth flow valve 58 may be in an open position to allow the portions of the exhaust flow to exit the legs 30, 32, 34, 36. The exhaust may exit the filter system 12 through outlet 28 and a sensor 48 may sense at least one parameter of the flow exiting the filter system 12. The parameter may be, for example, parts per million of NOx released by the filter system 12 after filtration, temperature, air to fuel ratio, or a combination of these parameters. The sensor 48 may send a signal corresponding to these sensed parameters to the controller 18. The controller may evaluate the information in the signal.

As the engine 10 operates, the NOx absorber 44 may chemically bind NOx in the exhaust gas of the engine 10 to its catalyst materials. However, the number of NOx storage sites on these catalysts may be limited. As more of these sites become occupied by NOx, the NOx absorber's ability to store NOx may decrease. This saturation process may take approximately several minutes depending on, for example, the type of engine 10, the run conditions, and the type of fuel used.

Figure 4:
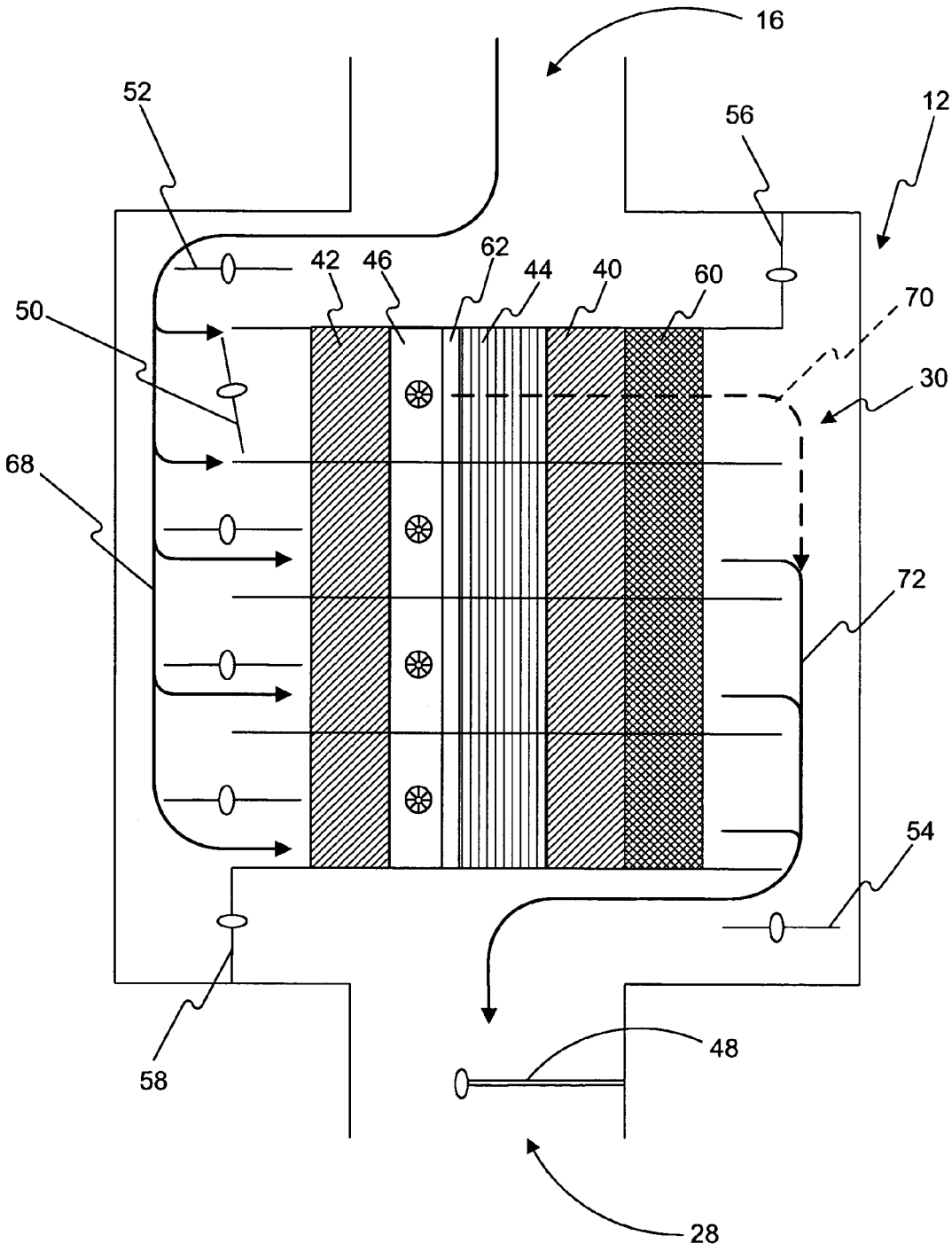
FIG. 4 is a front view diagrammatic illustration of the filter system of FIG. 2 in a reversed flow condition.

The controller 18 may use the information sent from the sensor 48 in conjunction with an algorithm or other pre-set criteria to determine whether the NOx absorber 44 has become saturated and is in need of regeneration. Once this saturation point has been reached, the controller 18 may send appropriate signals to the flow valves 52, 54, 56, 58. These signals may alter the position of the valves 52, 54, 56, 58 to reverse the flow of engine exhaust through the filter system 12, thereby beginning the regeneration process. This reversed flow condition is illustrated in FIG. 4. The algorithm of controller 18 may assist in this determination and may use the quantity of NOx particles sensed at the outlet 28 and stored regeneration histories or times for each leg 30, 32, 34, 36 as inputs. Alternatively (as mentioned above), a sensor may be located at the exit of each leg 30, 32, 34, 36 for detecting the parts per million of NOx being released downstream of each NOx absorber 44 of each leg 30, 32, 34, 36. This data may then be used by the controller 18 to determine the regeneration schedule.

In the reversed flow condition shown in FIG. 4, the first and second flow valves 52, 54 may be in an open position while the third and fourth flow valves 56, 58 may be in a closed position, thereby directing exhaust from the inlet 16 to flow in a direction corresponding to reversed flow arrows 68, 72. During reversed flow conditions, the second sulfur trap 42 will be upstream of the NOx absorber 44, and substantially all of the sulfur carried by the exhaust may be removed by the second sulfur trap 42 before the exhaust gas reaches the NOx absorber 44. As described above, under normal flow conditions, the second sulfur trap 42 may collect very little of the sulfur carried by the exhaust due to the presence of the first sulfur trap 40.

During the reversed flow condition, flow to the desired leg 30, 32, 34, 36 may be at least partially restricted by the regeneration valve 50 disposed in that leg. It is understood that each regeneration valve 50 may be capable of completely blocking flow to the desired leg 30, 32, 34, 36 under certain conditions. The desired leg may correspond to the leg 30, 32, 34, 36 to be regenerated. For example, to regenerate desired first leg 30, the controller 18 may send a signal to the regeneration valve 50 located in the first leg 30 thereby partially closing the valve 50. As FIG. 4 illustrates, only a restricted portion of the exhaust flow may continue to pass through the first leg 30 while the regeneration valve 50 is in the partially closed position. Restricting the flow may assist in creating an oxygen-starved operating condition within the NOx absorber. As will be described below, such an operating condition may be necessary for removing NOx from the catalyst material through regeneration. Although the overall flow through the first leg 30 is reduced as a result of the valve's position, the flow passing through the first leg 30 may still carry reductant through the leg 30 and may be a source of oxygen during the regeneration of that leg 30.

To create an oxygen-starved operating condition, the nozzle 46 may be activated to inject reductants into the exhaust flow in the desired leg. These reductants may be supplied to the nozzle 46 by a reformer 47 (FIG. 1). The reformer 47 may partially oxidize reductants with oxygen contained in air infused from an air supply (not shown). Through this oxidation process, the reformer 47 may produce refined or more effective reductants. The chemical makeup of these refined reductants may depend on the type of reductants supplied to the reformer 47 and may be, for example, carbon monoxide or hydrogen in a gaseous state. The reformer 47 may then feed these refined reductants to the nozzles 46 in each leg 30, 32, 34, 36 of the filter system 12.

As discussed above, if diesel fuel is used as a reductant, the fuel may be supplied to the nozzles 46 directly through direct reductant line 24, without being partially oxidized by the reformer 47. Alternatively, the reformer 47 may partially oxidize the fuel before the nozzles 46 inject it. Using unreformed diesel fuel as a reductant may require higher regeneration temperatures. However, if the diesel fuel is partially oxidized by the reformer 47 before being injected, the NOx absorber 44 may be regenerated at lower temperatures.

The injected reductants may be carried by the restricted portion of the exhaust flow traveling through the first leg and may be dispersed substantially uniformly across the surface of the NOx absorber 44 receiving the exhaust flow. The introduction of reductant may make the exhaust flow rich and may cause the NOx absorber 44 to regenerate and convert at least part of the NOx collected thereon to nitrogen. This rich exhaust flow is illustrated by arrow 70 in FIG. 4. The rich exhaust flow 70 may also cause the first sulfur trap 40 to regenerate and release collected sulfur. Regeneration of both the NOx absorber 44 and the sulfur trap 40 may be accomplished without the use of the heat supply 62.

Alternatively, the heat supply 62 may be activated during regeneration to increase temperature in the first leg 30 and thereby assist in the regeneration process. The controller may determine whether to activate the heat supply 62 based on the sensed temperature of the exhaust gas, the sensed temperature of the sulfur traps 40, 42, the sensed temperature of the NOx absorber 44, the sensed performance or flow of the filter system, or any other relevant criteria known in the art. If the heat supply 62 is configured to ignite the reductant injected by the nozzle 46, at least a portion of the restricted exhaust flow may be required to supply oxygen for the ignition. The heat supply 62 may increase the temperature within the leg 30, 32, 34, 36 to any appropriate temperature for reductant ignition or NOx absorber 44 regeneration. The heat supply may also be used to regenerate the particulate matter filter 60.

The regeneration process in the first leg 30 may result in a substantially clean NOx absorber 44 and first sulfur trap 40 in leg 30, while the second sulfur trap 42 in leg 30 may begin to store sulfur. This process may take less than one minute. It is understood that while the first leg 30 is being regenerated, exhaust flow may still travel through the other legs 32, 34, 36 of the filter system 12 as illustrated by arrow 68 and arrow 72.

It is also understood that during the regeneration process, the particulate matter filter 60 may be cleaned by any process known in the art. For example, once the ceramic substrate or other structure within the particulate matter filter 60 becomes saturated, the substrate may be heated by charging the structure with electric current. The current may increase the temperature of the structure to be in the range of approximately 600 to approximately 700 degrees Fahrenheit. The limited flow of exhaust through leg 30 during the regeneration process assists in the build-up of temperature in the particulate matter filter 60. At the appropriate temperature, the particulates may burn off of the substrate and be released from the particulate matter filter 60. Alternatively, the particulate matter filter 60 may be cleaned in a process whereby the particulates react with NOx. Such continuous regenerating traps ("CRT's") are known in the art and require an oxidation catalyst to burn off particulates.

Figure 5:
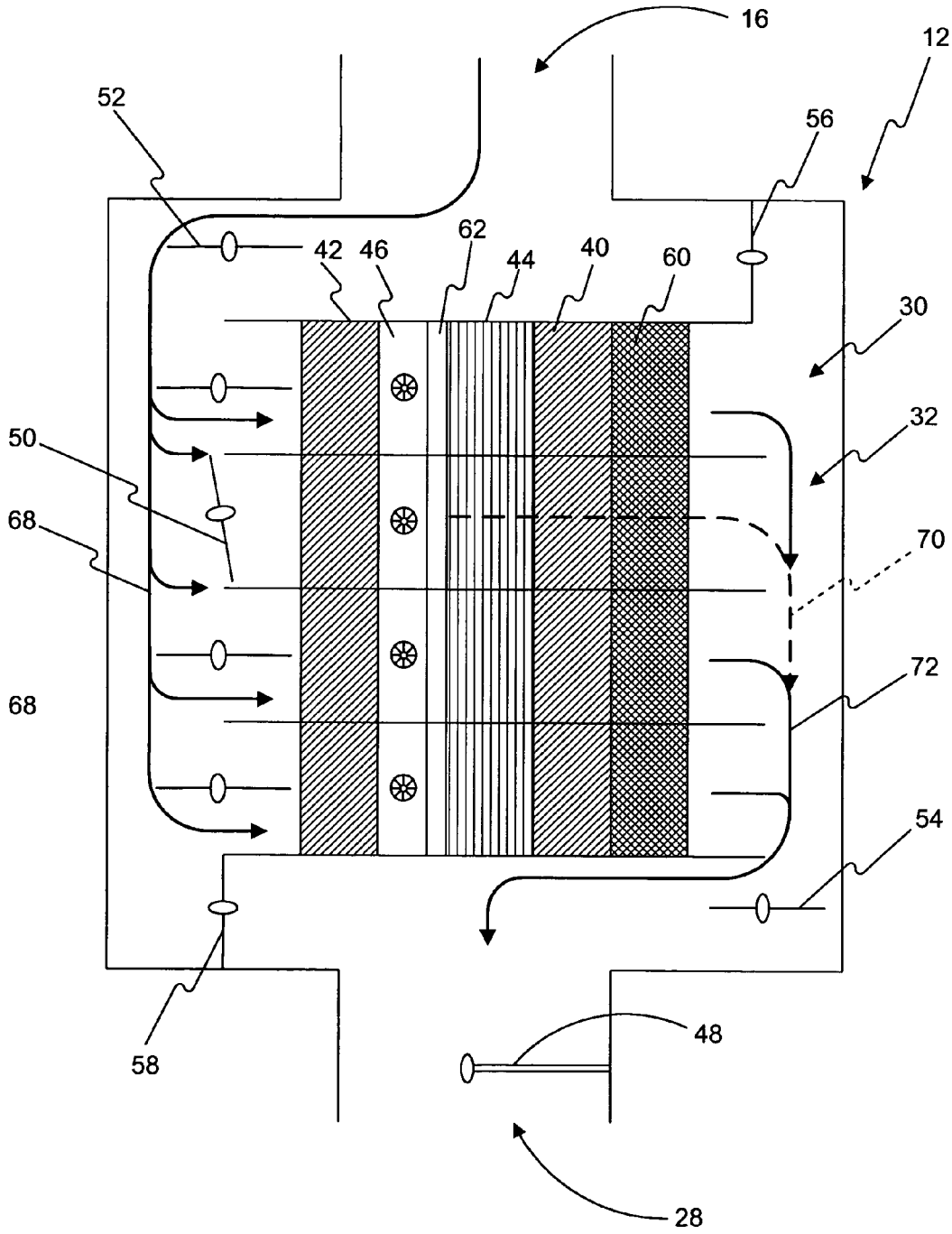
FIG. 5 is another front view diagrammatic illustration of the filter system of FIG. 2 in a reversed flow condition.

As shown in FIG. 5, once one of the legs 30, 32, 34, 36 has been regenerated, the process may begin in one of the other legs before the filter system 12 returns to the normal flow condition. Each of the legs 30, 32, 34, 36 may be regenerated while the filter system 12 is in a reversed flow condition, or alternatively, less than all of the legs 30, 32, 34, 36 may be regenerated. As described above, the controller 18 may determine which of the legs 30, 32, 34, 36 to regenerate based on an algorithm taking a number of variables into account. Once the desired legs 30, 32, 34, 36 have been regenerated, the filter system 12 may return to the normal flow condition illustrated in FIG. 3.

After repeatedly reversing the flow of exhaust through the filter system 12, the second sulfur trap 42 in each leg 30, 32, 34, 36 may become saturated with collected sulfur. In a process similar to the process described above with regard to the NOx absorbers 44, the controller 18 may determine which of the second sulfur traps 42 requires cleaning, and may initiate the desulfation process in one or more of the legs 30, 32, 34, 36 by at least partially restricting the flow of exhaust through the desired leg.

Figure 6:
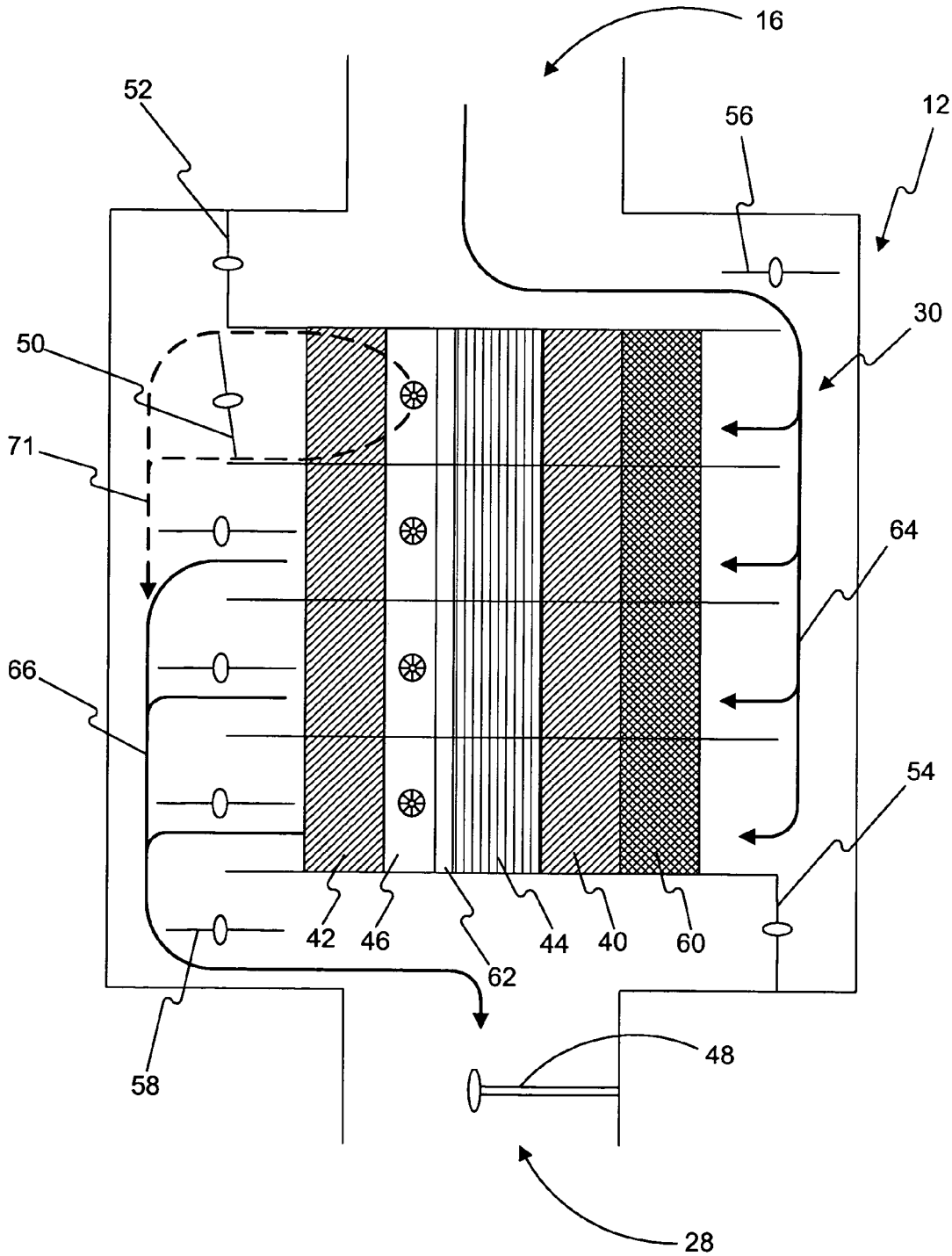
FIG. 6 is another front view diagrammatic illustration of the filter system of FIG. 2 in a normal flow condition.

For example, as shown in FIG. 6 with respect to desired first leg 30, to desulfate the second sulfur trap 42, the regeneration valve 50 may at least partially restrict flow through the first leg 30 while the filter system 12 operates under normal flow conditions. The nozzle 46 may be activated to inject reductant, making the exhaust gas contacting the second sulfur trap 42 rich as illustrated by arrow 71. This rich exhaust gas may cause the second sulfur trap 42 to release the collected sulfur, resulting in a clean second sulfur trap 42. Since flow may not be reversed during the desulfation of the second sulfur trap 42, the first sulfur trap 40 may continue to shield the NOx absorber 44 from sulfur and sulfur compounds during the desulfation process. The second sulfur traps 42 in each of the remaining legs 32, 34, 36 may be desulfated by substantially the same process. Each of the regeneration valves 50 may be fully opened after the desulfation of each second sulfur trap 42. It is understood that the reversed flow conditions and/or the regeneration processes of the embodiments illustrated in FIGS. 4–6 may also exist in the embodiments of FIGS. 2*a*–2*c*.

Other embodiments of the disclosed filter system will be apparent to those skilled in the art from consideration of the specification. For example, instead of injecting reductants into the exhaust flow of the engine 10 to create an oxygen-starved condition, the oxygen level of the exhaust flow may be reduced by increasing the main injection duration of engine fuel in the combustion chamber, or by adding a post fuel injection. This may enable most of the oxygen in the engine 10 to react with the injected fuel and may result in a surplus of fuel after combustion. As a result, there may be a relatively high percentage of reductants present in the exhaust gas relative to oxygen to facilitate regeneration.

In addition, the filter system 12 may include a second heat supply downstream of the nozzle 46 in each leg 30, 32, 34, 36. The second heat supply may assist in the desulfation of the second sulfur trap 42. The filter system 12 may also include an exhaust distributor plenum or other device capable of distributing the flow of exhaust evenly across each of the legs 30, 32, 34, 36. It is intended that the specification and examples be considered as exemplary only, with the true scope of the invention being indicated by the following claims.

What is claimed is:

1. A filter system, comprising:

a housing;

a valving mechanism fluidly connected to the filter system; and a plurality of filter sections disposed within the housing, each of the plurality of filter sections receiving a portion of flow, and each filter section comprising a first filter, a second filter, at least one flow control valve disposed proximate each filter section, each flow control valve and the valving mechanism together assisting in controllably directing the portion of flow through a said filter section, an absorbing material disposed between the first and second filter, and at least one dispersion mechanism disposed between the first and second filter, the at least one dispersion mechanism assisting in providing a fluid to the filter system.

2. The filter system of claim 1, wherein the first and second filters are sulfur traps.

3. The filter system of claim 1, wherein the absorbing material is catalyst material capable of storing oxides of nitrogen.

4. The filter system of claim 1, wherein the absorbing material is a NOx absorber.

5. The filter system of claim 1, wherein at least one flow control valve is configured to controllably restrict flow through a respective filter section.

6. The filter system of claim 1, wherein the fluid includes reductant.

7. The filter system of claim 1, further including at least one sensor configured to sense a filtered flow of the filter system.

8. The filter system of claim 1, each of the plurality of filter sections further including a heat supply configured to selectively supply heat to at least a portion of the respective filter section.

9. The filter system of claim 1, each of the plurality of filter sections further including a third filter different from the first and second filters, and located upstream of the absorber when the filter system is in a normal flow condition.

10. The filter system of claim 1, each of the plurality of filter sections further including a third filter different from the first and second filters, and located downstream of the absorber when the filter system is in a normal flow condition.

11. The filter system of claim 1, wherein the flow includes exhaust from an internal combustion engine.

12. The system of claim 1, wherein each at least one flow control valve is disposed within the housing of the filter system.

13. The system of claim 1, wherein the valving mechanism is disposed within the housing of the filter system.

14. The filter system of claim 1, wherein the valving mechanism is configured to reverse the direction of flow through at least one of the filter sections.

15. The filter system of claim 14, wherein the first filter is upstream of the absorbing material when the filter system is in a normal flow condition, and the second filter is upstream of the absorbing material when the filter system is in a reversed flow condition.

16. The filter system of claim 14, wherein the valving mechanism includes a plurality of valves.

17. The filter system of claim 1, wherein the at least one dispersion mechanism includes a nozzle configured to inject the fluid between the first and second filter.

18. The filter system of claim 17, further including a reformer in fluid communication with the nozzle and configured to partially oxidize the fluid injected by the nozzle.

19. A filter system of an internal combustion engine, comprising:

a first sulfur trap;

a second sulfur trap; and a NOx absorber disposed between the first and second sulfur trap.

20. The filter system of claim 19, further including a nozzle disposed between the first and second sulfur trap.

21. The filter system of claim 19, further including at least one valving mechanism configured to reverse a flow through the filter system.

22. The filter system of claim 19, further including at least one flow control valve configured to controllably restrict flow through the filter system.

23. The filter system of claim 19, further including at least one sensor configured to sense a filtered flow.

24. The filter system of claim 19, wherein the first and second sulfur traps are configured to at least one of adsorb and absorb sulfur from an exhaust flow of the internal combustion engine.

25. The filter system of claim 19, wherein at least one of the first and second sulfur traps is configured to adsorb or absorb sulfur.

26. The filter system of claim 19, further including a particulate matter filter configured to extract particulate matter from an exhaust flow.

27. The filter system of claim 19, further including:

a housing; and a plurality of filter sections disposed within the housing, each of the plurality of filter sections receiving a portion of flow, and at least one filter section of the plurality of filter sections comprising the first sulfur trap, the second sulfur trap, and the NOx absorber.

28. The filter system of claim 27, further including a valving mechanism fluidly connected to the filter system.

29. The filter system of claim 28, further including at least one flow control valve disposed proximate each filter section of the plurality of filter sections, each flow control valve and the valving mechanism together assisting in controllably directing the portion of flow through the plurality of filter sections.

30. A method for removing constituents from a flow of engine exhaust of an internal combustion engine, comprising:

removing constituents of the engine exhaust with a first sulfur trap upstream of a NOx absorber during a normal flow path through the filter system; and removing constituents adsorbing or absorbing sulfur of the engine exhaust with a second sulfur trap upstream of the NOx absorber during a reversed flow path through the filter system.

31. The method of claim 30, wherein the flow of engine exhaust through the filter system is alternated between the normal flow path and the reversed flow path by at least one valving mechanism.

32. The method of claim 30, further including controllably heating the flow of engine exhaust in the vicinity of the NOx absorber to assist in regenerating the NOx absorber.

33. The method of claim 30, wherein removing constituents of the engine exhaust with at least one of the first sulfur trap and the second sulfur trap comprises adsorbing or absorbing sulfur.

34. The method of claim 30, further including:

controllably directing a portion of the engine exhaust to each of a plurality of filter sections disposed within a housing of the filter system, at least one filter section of the plurality of filter sections comprising the first sulfur trap, the second sulfur trap, and the NOx absorber.

35. The method of claim 30, further including extracting particulate matter from the engine exhaust with a particulate matter filter.

36. The method of claim 30, further including injecting a reductant into the engine exhaust in a vicinity of the NOx absorber with at least one nozzle.

37. The method of claim 36, further including restricting a flow of engine exhaust through the NOx absorber when injecting the reductant.

38. A filter system, comprising:

a housing;

a valving mechanism fluidly connected to the filter system; and a plurality of filter sections disposed within the housing, each of the plurality of filter sections receiving a portion of flow, and each filter section comprising at least one flow control valve disposed proximate each filter section, each flow control valve and the valving mechanism together assisting in controllably directing flow through a said filter section, a first filter having a first filter portion and a second filter portion, a second filter, and at least one dispersion mechanism disposed between the first and second filter, the at least one dispersion mechanism assisting in providing a fluid to the filter system.

39. The system of claim 38, wherein the first filter portion contains catalyst material adapted to store oxides of sulfur.

40. The system of claim 38, wherein the second filter portion contains catalyst material adapted to store oxides of nitrogen.

41. The system of claim 38, wherein the first filter is a particulate mater filter and the second filter is a sulfur trap.

42. The system of claim 41, wherein the first filter portion contains catalyst material adapted to store oxides of sulfur and the second filter portion contains catalyst material adapted to store oxides of nitrogen.

43. The system of claim 38, further including a third filter.

44. The system of claim 43, wherein the first filter is a particulate matter filter.

45. The system of claim 44, wherein at least one of the first and second filter portions contains catalyst material capable of storing oxides of sulfur.

46. The system of claim 43, wherein the second filter is a NOx absorber.

47. The system of claim 43, wherein the third filter is a sulfur trap.

48. The system of claim 43, wherein the first filter is a particulate matter filter, the second filter is a NOx absorber, the third filter is a sulfur trap, and at least one of the first and second filter portions contains catalyst material capable of storing oxides of sulfur.

* * * * *